US005286559A

United States Patent [19]

Kaneko et al.

[11] Patent Number: 5,286,559

[45] Date of Patent: Feb. 15, 1994

[54] THERMAL TRANSFER SHEET

[75] Inventors: Hirokazu Kaneko; Hideichiro Takeda, both of Tokyo, Japan

[73] Assignee: Dai Nippon Insatsu Kabushiki Kaisha, Japan

[21] Appl. No.: 23,137

[22] Filed: Feb. 24, 1993

Related U.S. Application Data

[63] Continuation of Ser. No. 811,812, Dec. 20, 1991, abandoned, which is a continuation of Ser. No. 630,037, Dec. 19, 1990, Pat. No. 5,100,727.

[30] Foreign Application Priority Data

Dec. 20, 1989 [JP] Japan ..... 1-330159

[51] Int. Cl.[5] ..... B41M 5/26

[52] U.S. Cl. ..... 428/341; 428/195; 428/480; 428/488.4; 428/913; 428/914

[58] Field of Search ..... 428/195, 341, 480, 488.4, 428/913, 914

[56] References Cited

U.S. PATENT DOCUMENTS 4,806,422 2/1989 Ohno et al. ..... 428/141

*Primary Examiner*—Marion E. McCamish
*Assistant Examiner*—Elizabeth Evans
*Attorney, Agent, or Firm*—Ladas & Parry

[57] ABSTRACT

A thermal transfer sheet comprising a substratte film, a transferable ink layer formed on one surface side of the substrate film, and a back coating layer formed on the other surface side of the substrate film to be in contact with a thermal head, wherein the transferable ink layer comprises a heat-fusible ink capable of being melted under heating, and the back coating layer comprises a binder predominantly comprising polyparabanic acid.

10 Claims, 1 Drawing Sheet

THERMAL TRANSFER SHEET

This is a continuation of copending application Ser. No. 07/811,812 filed on Dec. 20, 1991 now abandoned, which is a continuation of copending application Ser. No. 07/630,037 filed on Dec. 19, 1990 and issued as U.S. Pat. No. 5,100,727.

FIELD OF THE INVENTION AND RELATED ART

The present invention relates to a thermal transfer sheet, particularly to a thermal transfer sheet having an excellent heat-resistant slip coating layer (back coating layer) comprising a specific material.

Hitherto, in a case where output from a computer or word processor is printed by a thermal transfer system, there has been used a thermal transfer sheet comprising a substrate film and a heat-fusible ink layer disposed on one surface side thereof.

Such a conventional thermal transfer sheet comprises a substrate film comprising a paper having a thickness of 10 to 20 μm such as capacitor paper and paraffin paper, or comprising a plastic film having a thickness of 3 to 20 μm such as polyester film and cellophane film. The above-mentioned thermal transfer sheet has been prepared by coating the substrate film with a heat-fusible ink comprising a wax and a colorant such as dye or pigment mixed therein, to form a heat-fusible ink layer on the substrate film.

In the prior art, in a case where a material susceptible to heat such as plastic film is used as the substrate film, a thermal head used for printing is liable to adhere to the substrate film to cause a sticking phenomenon. As a result, there may be posed a problem such that the thermal head causes peeling, the slip property thereof is impaired, the substrate film is broken, etc.

Accordingly, there has been proposed a method wherein a heat-resistant layer is formed by using a heat-resistant material such as thermosetting resin. In this method, however, it is necessary to used a curing agent such as crosslinking agent, and to used a curing agent such as crosslinking agent, and to used two component-type coating liquid, at the time of formation of the heat-resistant layer. Further, since the substrate film is a plastic film, heat-treatment at a relatively low temperature is required for a long time extending for several tens of hours. Such an operation is troublesome in view of the production process and further poses a problem such that wrinkles can occur without strict temperature control.

In order to solve such a problem, a method using various thermoplastic resins having a high softening point has been proposed. However, such a heat-resistant resin is difficult to be dissolved in an ordinary organic solvent and is not easy to be formed into a thin film. Further, since the above-mentioned resins to be used for such a purpose are thermoplastic resins, the heat-resistance of the resultant back coating layer is rather limited, and the adhesion property thereof with the substrate film is poor, whereby a back coating layer suitable for practical use has not been formed.

SUMMARY OF THE INVENTION

A principal object of the present invention is to solve the above-mentioned problems encountered in the prior art and to provide a thermal transfer sheet containing a back coating layer having excellent heat resistance and solvent resistance, by using a one-component type coating liquid containing a thermoplastic resin without troublesome heat treatment.

According to the present invention, there is provided a thermal transfer sheet comprising a substrate film, a transferable ink layer formed on one surface side of the substrate film, and a back coating layer formed on the other surface side of the substrate film to be in contact with a thermal head; wherein the transferable ink layer comprises a heat-fusible ink capable of being melted under heating, and the back coating layer comprises a binder predominantly comprising polyparabanic acid.

In the present invention, a thermal transfer sheet provided with a back coating layer having excellent heat resistance and solvent resistance may be provided without the use of troublesome heat treatment by using polyparabanic acid as a resin for the formation of the back coating layer.

These and other objects, features and advantages of the present invention will become more apparent upon a consideration of the following description of the preferred embodiments of the present invention taken in conjunction with the accompanying drawings.

DETAILED DESCRIPTION OF PREFERRED EMBODIMENTS

Hereinbelow, the present invention is specifically described with preferred embodiments thereof.

Figure 1:
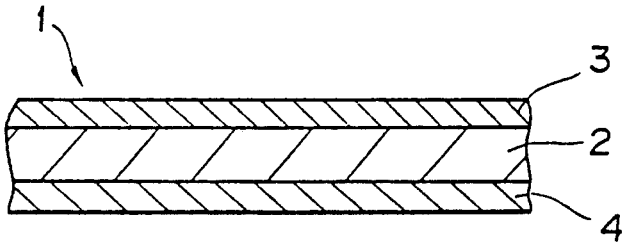
FIG. 1 is a schematic sectional view showing an embodiment of the thermal transfer sheet according to the present invention.

FIG. 1 is a schematic sectional view showing an embodiment of the thermal transfer sheet according to the present invention. Referring to FIG. 1, the thermal transfer sheet 1 comprises a substrate film 2, a back coating layer 3 formed on one surface side of the substrate film 2, and a transferable ink layer 4 formed on the other surface side of the substrate film 2.

The substrate film 2 to be used in the present invention may be one selected from those used in the conventional thermal transfer sheet. However, the above-mentioned substrate film 2 is not restricted thereto and can be any of other films.

Preferred examples of the substrate film 2 may include: plastic films such as those comprising polyester, polypropylene, cellophane, polycarbonate, cellulose acetate, polyethylene, polyvinyl chloride, polystyrene, nylon, polyimide, polyvinylidene chloride, polyvinyl alcohol, fluorine-containing resin, chlorinated rubber, and ionomer resin; papers such as capacitor paper and paraffin paper; non-woven fabric; etc. The substrate film 2 can also comprise a composite or laminate of the above-mentioned films.

The substrate film 2 may preferably have a thickness of 0.5 to 50 μm, more preferably 3 to 10 μm, while the thickness can appropriately be changed corresponding to the materials thereof so as to provide suitable strength and heat conductivity.

The back coating layer 3 primarily characterizing the present invention is formed on one surface side of the above-mentioned substrate film 2. The above-mentioned back coating layer 3 is capable of contacting a thermal head. The substrate film 2 may preferably be one having a relatively high heat resistance such as polyethylene terephthalate film.

The above-mentioned back coating layer 3 comprises polyparabanic acid as a predominant (or essential) component or a binder resin, and an optional additive.

The polyparabanic acid to be used in the present invention is a polymer comprising the following recurring unit (1):

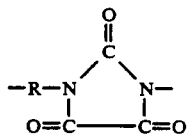

(1)

wherein the groups represented by R denote the same or different divalent organic groups capable of having a substituent.

The above-mentioned polyparabanic acid may be prepared by hydrolyzing a cyclic (or cyclized) addition polymer which has been prepared from a diisocyanate compound and hydrogen cyanide. When a single diisocyanate is used as the above-mentioned diisocyanate compound, a homopolymer may be obtained. When a plurality of diisocyanates are used as the above-mentioned diisocyanate compound, a copolymer may be obtained. As a matter of course, the process for producing the isocyanate compound is not restricted to the above-mentioned method, but may be another production process.

Specific examples of the diisocyanate compound to be used in the present invention may include: 4,4'-diphenylmethane diisocyanate (MDI), hydrogenated MDI, isophorone diisocyanate, 1,3-xylylene diisocyanate, 1,4-xylylene diisocyanate, 2,4-tolylene diisocyantate, 2,6-tolylene diisocyanate, 1,5-naphthalene diisocyanate, m-phenylene diisocyanate, p-phenylene diisocyanate, etc. Among these, it is preferred to use aromatic diisocyanate such as a mixture of diphenylmethane diisocyanate and another aromatic diisocyanate (e.g., tolylene diisocyanate).

While the above-mentioned poly-parabanic acid may easily be prepared in the above-mentioned manner, it is available from, e.g., Tohnen Sekiyu Kagaku K. K. under the tradename of "SOLLAC", etc., so as to be used in the present invention.

According to our detailed investigations, it has been found that the polyparabanic acid suitable for the purpose of the present invention is one which has been selected from various grades or species thereof and has a molecular weight corresponding to an intrinsic viscosity of 0.3 to 3 at 30° C., when measured in dimethylformamide.

Figure 2:
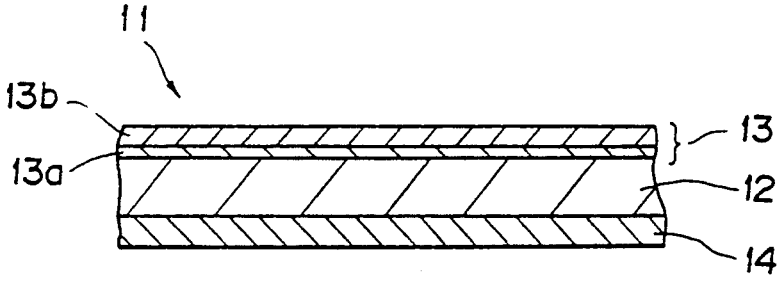
FIG. 2 is a schematic sectional view showing another embodiment of the thermal transfer sheet according to the present invention.

In a case where polyethylene-terephthalate film is selected as a substrate film, the adhesion between the above-mentioned poly-parabanic acid and the substrate film is not necessarily sufficient in some cases. In such a case, it is preferred to use a small amount of another adhesive resin in combination with the polyparabanic acid. Alternatively, it is also possible that the thermal transfer sheet is caused to have a structure as shown in FIG. 2. More specifically, referring to FIG. 2, the thermal transfer sheet 11 in this embodiment comprises a substrate film 12, a back coating layer 13 having a two-layer structure disposed on one surface side of the substrate film 12, and a transferable ink layer 14 disposed on the other surface side of the substrate film 12. The back coating layer 13 may comprise a primer layer **13*a* comprising an adhesive resin disposed on the substrate film 12, and a layer 13*b* predominantly comprising polyparabanic acid disposed on the primer layer 13*a***.

The adhesive resin may preferably comprise an amorphous linear saturated polyester resin having a glass transition point of 50° C. or higher. Example of such a polyester resin may include: those sold under the trade names of Bairon (mfd. by Toyobo K. K.), Eriter (mfd. by Unitika K. K.), Polyester (mfd. by Nihon Gosei Kagaku K. K.), etc. These resins of various grades are commercially available, and any of these resins can be used in the present invention.

Particularly preferred examples of such a resin may include Bairon RV 290 (mfd. by Toyobo K. K., product containing epoxy groups introduced thereinto, molecular weight $=2.0\times10^4$ to $2.5\times10^4$, Tg=77° C., softening point=180° C., hydroxyl value=5 to 8).

In a case where the above-mentioned polyester resin is used for forming the primer layer **13*a* (i.e., in the case of the thermal transfer sheet as shown in FIG. 2**), it is preferred to form the primer layer having a thickness of about 0.05 to 0.5 μm. If the thickness is too small, the resultant adhesive property may be insufficient. If the thickness is too large, sensitivity to a thermal head or heat resistance may undesirably be lowered.

In a case where the adhesive resin is used in a mixture with the above-mentioned polyparabanic acid, the adhesive resin content may preferably be 1 to 50 wt. parts per 100 wt. parts of the polyparabanic acid. If the adhesive resin content is too low, the resultant adhesive property may be insufficient. If the adhesive resin content is too high, the heat resistance of the back coating layer 3 may be lowered, or sticking may be caused.

As a matter of course, to such an extent where the object of the present invention is not substantially impaired, it is also possible to use a small amount of another binder resin in combination in the back coating layer.

Specific examples of such a binder resin may include: cellulose resins such as ethylcellulose, hydroxyethyl cellulose, ethyl-hydroxy-ethylcellulose, hydroxypropyl cellulose, methylcellulose, cellulose acetate, cellulose acetate butyrate, and nitrocellulose; vinyl-type resins such as polyvinyl alcohol, polyvinyl acetate, polyvinyl butyral, polyvinyl acetal, polyvinyl pyrrolidone, polyacrylamide, and acrylonitrile-styrene copolymer; polyester resin, polyurethane resin, silicone-modified or fluorine-modified urethane resin, etc.

In the present invention, when the back coating layer 3 or 13 is formed by using the above-mentioned material, a thermal release agent or lubricating agent (or lubricant) may also be contained therein, within such an extent that the addition thereof does not substantially obstruct the achievement of the object of the present invention. Specific examples of such a release agent or lubricating agent may include natural wax, synthetic wax, higher fatty acid amide, ester, surfactant, higher fatty acid metal salt, and alkylphosphoric acid ester metal salt. Especially, in the case of giving a slip property to the back coating layer, it is desired to use silicone wax.

In order to improve the heat-resistance of the back coating layer 3 or 13, it is possible to incorporate therein fine particles as a heat resistance-imparting agent. Specific examples thereof may include: Hydrotalsite DHT-4A (mfd. by Kyowa Kagaku Kogyo), Talcmicroace L-1 (mfd. by Nihon Talc), Teflon Rubron L-2 (mfd. by Daikin Kogyo), Fluorinated Graphite SCP-10 (mfd. by Sanpo Kagaku Kogyo), Graphite AT40 S (mfd. by Oriental Sangyo), and fine particles such as silica, calcium carbonate, precipitated barium surfate, crosslinked urea resin powder, crosslinked melamine resin powder, crosslinked styrene-acrylic resin powder, crosslinked amino resin powder, silicone resin powder, wood meal, molybdenum disulfide, and boron nitride.

Further, in order to impart an antistatic property to the back coating layer 3 or 13, it is possible to add thereto a conductivity-imparting agent such as carbon black.

The back coating layer 3 or 13 may be formed by dissolving or dispersing the above-mentioned material in an appropriate solvent such as dimethylformamide, N-methylpyrrolidone, dimethylacetamide, dimethylsulfoxide, hexamethylsulfonamide, cyclohexanone, acetone, methyl ethyl ketone, toluene and xylene to prepare a coating liquid; and applying the coating liquid by an ordinary coating means such as gravure coater, roll coater, and wire bar; and drying the resultant coating.

The coating amount of the back coating layer 3 or 13, i.e., the thickness thereof, is also important. In the present invention, a back coating layer having sufficient performances may preferably be formed by using a coating amount of 0.6 $g/m^2$ or below, more preferably 0.1 to 0.6 $g/m^2$, based on the solid content thereof. If the back coating layer is too thick, the thermal sensitivity at the time of transfer operation may undesirably be lowered.

In the present invention, it is also effective to form a primer layer comprising a polyester resin, polyurethan resin, etc., on the substrate film 2 or 12, prior to the formation of the above-mentioned back coating layer 3 or 13.

In the present invention, a heat-fusible transferable ink layer 4 or 14 may be formed on the other surface side of the above-mentioned substrate film, by using an ink comprising predetermined materials.

The ink to be used for forming the formation of the heat-fusible transferable ink layer in the present invention comprises a colorant and a vehicle. The heat-fusible ink can also contain an optical additive selected from various species thereof, as desired.

The colorant may preferably be one having a good recording property as a recording material, which is selected from organic or inorganic dyes or pigments. For example, the colorant may preferably be one having a sufficient coloring density (or coloring power) and is not substantially faded due to light, heat, temperature, etc.

The colorant can also comprise a substance such that it is colorless under no heating but develops a color under heating, a substance capable of developing a color when it contacts another substance which has been applied onto a transfer-receiving member. The colorant may be one capable of providing various colors in illusive of cyan, magenta, yellow, and black.

The vehicle may predominantly comprise a wax or may comprise a mixture of a wax and another component such as drying oil, resin, mineral oil, and derivatives of cellulose and rubber.

Representative examples of the wax may include microrystalline wax, carnauba wax, paraffine wax, etc. In addition, specific examples of the wax may include: various species thereof such as Fischer-tropsch wax, various low-molecular weight polyethylene, Japan wax, beeswax, whale wax, insect wax, lanolin, shellac wax, candelilla wax, petrolactam, partially modified wax, fatty acid ester, and fatty acid amide.

In order to impart good heat conductivity and melt-transferablity to the heat-fusible transferable ink layer 4 or 14, a heat-conducting substance can also be incorporated into the heat-fusible ink. Specific examples of such a heat-conducting substance may include carbon substances such as carbon black, aluminum, copper, tin oxide, and molybdenum disulfide.

In order to directly or indirectly form a heat-fusible transferable ink layer 4 or 14 on a substrate film 2 or 12, there may be used a method such as hot-melt coating, hot-lacquer coating, gravure coating, gravure reverse coating and roller coating. The thickness of the ink layer to be formed should be determined so that the requisite image density and thermal sensitivity are balanced with each other. The thickness may preferably be 0.1 to 30 μm, more preferably 1 to 20 μm.

In the present invention, it is possible to further disposed a surface layer on the above-mentioned ink layer 4 or 14. The surface layer constitutes a portions of a transferable film and has a function such that it forms a surface on one surface side contacting a transfer-receiving paper and sealing the printed portion of the transfer-receiving paper, and it prevent ground staining and enhances the adhesion property of the ink layer to the transfer-receiving paper.

The surface layer may comprise a wax which is the same as that used in the above-mentioned heat-fusible transferable ink layer.

The surface layer comprising a wax may be formed by applying a liquid of melted wax and cooling the resultant coating; by applying a solution of the wax in an organic solvent and drying the resultant coating; by applying an aqueous dispersion containing particles of the wax and drying the resultant coating, etc..

The surface layer may be formed by using various techniques in the same manner as in the formation of the ink layer. The surface layer may be selected so that the sensitivity does not become insufficient even in the case of a high-speed type printer using a low printing energy. In the present invention, the surface layer may preferably have a thickness which is not smaller than 0.1 μm and smaller than 5 μm.

It is preferred to add an appropriate amount of extender pigment to the surface layer, since such a pigment prevents blurring or tailing of printed letters more effectively.

The printed letter obtained by thermal transfer method generally has a gloss and is beautiful, in some cases, such printed letters can decrease the readableness of the resultant document. Accordingly, dull printed images are sometimes preferred. In such a case, it is preferred that a dispersion obtained by dispersing an inorganic pigment such as silica and calcium carbonate in appropriate resin and solvent is applied onto a substrate film to form thereon a mat layer, and then a heat-fusible ink transferable is applied onto the mat layer; thereby to prepare a thermal transfer sheet, as proposed by our research group in Japanese Patent Application No. 208306/1983. Alternatively, it is possible to mat a substrate film per se, as proposed by our research group in Japanese Patent Application No. 208307/1983.

As a matter of course, the present invention is applicable to a thermal transfer sheet for color printing. Accordingly, a multi-color thermal transfer sheet is also within the scope of the present invention.

As described above, according to the present invention, polyparabanic acid is used as a resin constituting a back coating layer, there is provided a thermal transfer sheet having a back coating layer excellent in heat resistance, without troublesome heat treatment.

Experimental Example

Hereinbelow, the thermal transfer sheet according to the present invention is described in more detail with reference to Experimental Examples. In the description and Tables appearing hereinafter, "part(s)" and "%" are "part(s) by weight" and "% by weight", respectively, unless otherwise noted specifically.

EXAMPLES 1 TO 5

Ink composition (1) for back coating layer

| | |
|---|---|
| Polyparabanic acid (SOLLAC PPA-XT-101, *molecular weight $\eta_{inh}$ = 1.0, thermal decomposition temperature = 449° C., mfd. by Tohnen Sekiyu Kagaku K.K.) | 30 parts |
| Linear saturated polyester resin (trade name: Bairon 200, solid content = 15%, mfd. by Toyobo K.K.) | 10 parts |
| Crosslinked melamine resin powder (Epostar S, mfd. by Nihon Kasei K.K.) | 15 parts |
| Cyclohexanone | 120 parts |
| Dimethlformamide | 60 parts |

*Hereinafter, molecular weight $\eta_{inh}$ is one that was obtained to measure the flow velocity of N, N-dimethyl formamide (DMF) dissolving polyparabanic acid by means of Ubbelohde viscometer.

Ink composition (2) for back coating layer

| | |
|---|---|
| Polyparabanic acid (SOLLAC PPA-XT-103, molecular weight $\eta_{inh}$ = 0.6, thermal decomposition temperature = 443° C., mfd. by Tohnen Sekiyu Kagaku K.K.) | 30 parts |
| Linear saturated polyester resin (trade name: Bairon 200, solid content = 15%, mfd. by Toyobo K.K.) | 10 parts |
| Zinc stearate | 15 parts |
| Cyclohexanone | 120 parts |
| Dimethylformamide | 60 parts |

Ink composition (3) for back coating layer

| | |
|---|---|
| Polyparabanic acid (SOLLAC PPA-M, molecular weight $\eta_{inh}$ = 0.6, mfd. by Tohnen Sekiyu Kagaku K.K.) | 25 parts |
| Linear saturated polyester resin (trade name: Bairon 240, solid content = 15%, mfd. by Toyobo K.K.) | 5 parts |
| Wax (Kao Wax 220, mfd. by Kao K.K.) | 6 parts |
| Cyclohexanone | 50 parts |
| Dimethylformamide | 30 parts |

Ink composition (4) for back coating layer

| | |
|---|---|
| Polyparabanic acid (SOLLAC PPA-M, molecular weight $\eta_{inh}$ = 0.6, mfd. by Tohnen Sekiyu Kagaku K.K.) | 25 parts |
| Linear saturated polyester resin (trade name: Bairon 300, solid content = 15%, mfd. by Toyobo K.K.) | 2 parts |
| Urethane-modified silicone (SP 2131, solid content = 20%, mfd. by Dainichi Seika K.K.) | 3 parts |
| Cyclohexanone | 15 parts |
| Dimethlformamide | 8 parts |

Ink composition (5) for back coating layer

| | |
|---|---|
| Polyparabanic acid (SOLLAC PPA-M, molecular weight $\eta_{inh}$ = 0.4, thermal decomposition temperature = 439° C., mfd. by Tohnen Sekiyu Kagaku K.K.) | 100 parts |
| Linear saturated polyester resin (trade name: Bairon 200, solid content = 15%, mfd. by Toyobo K.K.) | 6 parts |
| Zinc stearate (trade name: LBT-1830, mfd. Sakai Kagaku K.K.) | 12 parts |
| Cyclohexanone | 450 parts |
| Methyl ethyl kefone (MEK) (It will be able to use acetone instead of MEK) | 450 parts |

With respect to the above-mentioned ink compositions, respective components were mixed under stirring and subjected to dispersing treatment for three hours by means of a paint shaker. To the resultant product, an appropriate amount of a diluting solvent (cyclohexanone or cyclohexanone/MEK=1/1) was added, thereby to prepare the above-mentioned respective inks for back coating layer.

Each of the above-mentioned inks was applied onto one surface side of a polyester film having a thickness of 6 μm (Lumirror F-53, mfd. by Toray K.K.) by means of a wire bar coater so as to provide coating amounts of 0.2 g/m$^2$ and 0.5 g/m$^2$ based on their solid content, respectively, and then the resultant coating was dried by using hot air, thereby to form a back coating layer as shown in FIG. 1.

EXAMPLE 6

(combination with primer coating material)

5 parts of an epoxy-modified linear saturated polyester resin (Bairon RV 290, Tg=77° C., mp=180° C., mfd. by Toyobo K.K.) was dissolved in 95 parts of a mixture solvent (MEK/toluene=1/1), thereby to prepare a primer coating material.

The thus prepared primer coating material was applied onto a substrate film comprising a 6 μm-thick polyethylene terephthalate by means of a wire bar coater so as to provide a coating amount of 0.2 g/m$^2$ (based on solid content) and the resultant coating was dried, thereby to form a primer layer.

Thereafter, an ink composition which comprised the same components as those used in the composition (1) in Example 1 except for the linear saturated polyester resin was applied onto the above-mentioned primer layer so as to provide a coating amount of 0.3 g/m$^2$ (based on solid content) and the resultant coating was dried, thereby to form a back coating layer as shown in FIG. 2.

Separately, a transferable ink compositions comprising the following component as a heat-fusible ink was prepared by melt-kneading respective components by means of a blade kneader at 100° C. for 6 hours.

Ink for transferable ink layer

| | |
|---|---|
| Paraffin wax | 10 |
| Carnauba wax | 10 |
| Ethylene-vinyl acetate copolymer (Sumitate HC-10, mfd. by Sumitomo Kagaku K.K.) | 7 |
| Carbon black (Seast 3, mfd. by Tokai Denkyoku K.K.) | 13 |

The above ink composition was heated at 100° C. and applied onto the other surface side (i.e., a surface side other than that provide with the above-mentioned back coating film) of each of the substrate films by a hot-melt roll coating method so as to provide a coating amount of about 5.0 g/m$^2$, to form a heat-transferable ink layer, whereby a thermal transfer sheet according to the present invention was obtained.

The thermal transfer sheet according to the present invention prepared above was loaded on a thermal printer and subjected to printing so as to provide printed letters on plain paper under the following conditions:

Output: 1 W/dot

Pulse duration (or pulse width): 0.3 to 4.5 m sec

Dot density: 3 dots/mm

As a result, no sticking phenomenen occured, no wrinkle was formed, and the thermal transfer sheet was smoothly conveyed, whereby no problem was posed.

Comparative Example 1

A thermal transfer sheet of Comparative Example 1 was prepared in the same manner as in Example 1 except that a partially saponified vinyl chloride-vinylacetate copolymer resin (Vinylite VAGH, mfd. by UCC) was used as the binder resin.

When the thus obtained thermal transfer sheet was subjected to a printing test in the same manner as in Example 1, considerable sticking phenomenon occurred and printing was impossible.

Further, with respect to the thermal transfer sheets of Examples and Comparative Example, friction coefficient, anti-sticking property and anti-staining property were measured or evaluated.

The results are shown in the following Table 1.

TABLE 1

| Example | | Example 1 | | Example 2 | | Example 3 | | Example 4 | | Example 5 | Example 6 | | Comparative Example 1 | |
|---|---|---|---|---|---|---|---|---|---|---|---|---|---|---|
| Coating amount of back coating layer | | 0.2 g | 0.5 g | 0.2 g | 0.5 g | 0.2 g | 0.5 g | 0.2 g | 0.5 g | 0.3 g | 0.2 g | 0.5 g | 0.2 g | 0.5 g |
| Friction coefficient | Static friction | — | 0.15 | — | 0.40 | — | 0.24 | — | 0.18 | 0.30 | — | 0.15 | — | 0.21 |
| | Dynamic friction | — | 0.13 | — | 0.28 | — | 0.23 | — | 0.13 | 0.25 | — | 0.13 | — | 0.18 |
| Anti-sticking | Device for test | ○ | ○ | ○ | ○ | ○ | ○ | ○ | ○ | ○ | ○ | ○ | X | X |
| | Device for practical use | ○ | ○ | ○ | ○ | ○ | ○ | ○ | ○ | ○ | Δ | ○ | X | X |
| Storability | 55° C. | ○ | ○ | ○ | ○ | ○ | ○ | ○ | ○ | ○ | ○ | ○ | X | X |
| | 60° C. | ○ | ○ | ○ | ○ | ○ | ○ | ○ | ○ | ○ | ○ | ○ | X | X |

In the above Table 1, the symbols ○, Δ and X respectively denote the following meanings ○: No problem was posed.

Δ: The results were somewhat problematic.

X: The thermal transfer sheet was difficult to be used.

Friction coefficient

The friction coefficient between the back coating layers was measured under a load of 100 g/cm at a speed of 100 mm/min.

Anti-sticking property

1) Device for test:
   thin film head 6 d/mm, 17 V,
   2 ms=1.66 mj/d
   solid image
2) Device for practical use: partially grazed thin film head 8 d/mm, solid image

Storability

The surface of the ink coating layer of the test piece (50×50 mm) was superposed on the back coating layer thereof, and evaluation was conducted by using a blocking tester under a predetermined load under the following conditions.

(1) 55° C., 5 kg/cm$^2$, 48 hours (2) 60° C., 2 kg/cm$^2$, 24 hours

What is claimed is:

1. A thermal transfer sheet comprising substrate film, a transferable ink layer formed on one surface side of the substrate film, and a back coating layer formed on the other surface side of the substrate film to be in contact with a thermal head; wherein the transferable ink layer comprises a heat-fusible ink capable of being melted under heating, and the back coating layer comprises a binder predominantly comprising polyparabanic acid wherein said polyparabanic acid comprises a polymer prepared by hydrolyzing a cyclic addition polymer which is prepared by a hydrogen cyanide and a diisocyanate compound selected from at least one of 2, 4-tolylene diisocyanate and 2, 6-tolylene diisocyanate.

2. A thermal transfer sheet according to claim 1, wherein the polyparabanic acid has an intrinsic viscosity of 0.3 to 3 at 30° C. in dimethyl-formamide.

3. A thermal transfer sheet according to claim 1, wherein the back coating layer has a thickness of 0.1 to 0.6 g/m$^2$ based on its solid content.

4. A thermal transfer sheet comprising a substrate film, a transferable ink layer formed on one surface side of the substrate film, and a back coating layer formed on the other surface side of the substrate film to be in contact with a thermal head; wherein the transferable ink layer comprises a heat-fusible ink capable of being melted under heating, and the back coating layer comprises a binder predominantly comprising polyparabanic acid and a linear polyester resin as an adhesive resin.

5. A thermal transfer sheet according to claim 4, wherein the linear polyester resin is mixed in the back coating layer in an amount of 1 to 50 wt. parts per 100 wt. parts of the polyparabanic acid.

6. A thermal transfer sheet according to claim 4, wherein the linear polyester resin has a glass transition point of 50° C. or higher.

7. A thermal transfer sheet according to claim 4, wherein the back coating layer has a thickness of 0.1 to 0.6 g/m$^2$ based on its solid content.

8. A thermal transfer sheet comprising a substrate film, a transferable ink layer formed on one surface side of the substrate film, and a back coating layer formed on the other surface side of the substrate film to be in contact with a thermal head, wherein the transferable ink layer comprises a heat-fusible ink capable of being melted under heating, and the back coating layer of a two-layer structure comprising a primer layer having a thickness of 0.05 to 0.5/μm and comprising a linear polyester resin and a layer predominantly comprising polyparabanic acid.

9. A thermal transfer sheet according to claim 8, wherein the linear polyester resin has a glass transition point of 50° C. or higher.

10. A thermal transfer sheet according to claim 8, wherein the back coating layer has a thickness of 0.1 to 0.6 $g/m^2$ based on its solid content.

* * * * *